US007875157B2

(12) United States Patent
Loomis et al.

(10) Patent No.: US 7,875,157 B2
(45) Date of Patent: Jan. 25, 2011

(54) COMPOSITE ANODE WELL AND REVITILIZATION METHOD

(75) Inventors: Kevin Loomis, EastSound, WA (US); Stuart Ell, Marysville, WA (US)

(73) Assignee: Moor Anode, Inc., Eastsound, WA (US)

( * ) Notice: Subject to any disclaimer, the term of this patent is extended or adjusted under 35 U.S.C. 154(b) by 437 days.

(21) Appl. No.: 12/123,001

(22) Filed: May 19, 2008

(65) Prior Publication Data

US 2009/0272643 A1 Nov. 5, 2009

Related U.S. Application Data

(60) Provisional application No. 61/049,309, filed on Apr. 30, 2008.

(51) Int. Cl.
*C23F 13/06* (2006.01)

(52) U.S. Cl. ..... 204/196.2; 204/196.11; 204/196.21; 204/196.26; 204/196.33; 204/196.36; 204/196.37

(58) Field of Classification Search ..... 204/196.11, 204/196.2, 196.21, 196.26, 196.33, 196.34, 204/196.36, 196.37
See application file for complete search history.

(56) References Cited

U.S. PATENT DOCUMENTS 4,175,021 A * 11/1979 Tatum et al. ..... 204/196.36
4,544,464 A * 10/1985 Bianchi et al. ..... 205/724
5,139,634 A * 8/1992 Carpenter et al. ..... 205/727
5,309,994 A * 5/1994 Douglas et al. ..... 166/278

* cited by examiner

*Primary Examiner*—Bruce F Bell
(74) *Attorney, Agent, or Firm*—Jellett IP Law PS

(57) ABSTRACT

A composite reconstituted anode well. The composite well has a first while section and a second regenerative section. The first well section has a pre-existing anode well earthen wall, pre-existing sacrificed carbon material, pre-existing sacrificed anode materials, and pre-existing sacrificed well casing. The second regenerative section has a regenerative well casing, regenerative anodes, and regenerative carbon material. The regenerative well casing is driven into the first well section which compacts the pre-existing sacrificed carbon material, pre-existing sacrificed anode materials, and pre-existing sacrificed well casing against the pre-existing anode well earthen wall which forms a first outer section of the composite reconstituted anode well. The regenerative anodes are placed inside the regenerative well casing, and regenerative carbon material is filled inside the regenerative well casing which encases the regenerative anodes and forms the inner well section. The first outer section and the first inner section result in the composite reconstituted anode well.

37 Claims, 6 Drawing Sheets

COMPOSITE ANODE WELL AND REVITILIZATION METHOD

RELATED APPLICATIONS

This application claims priority benefit of U.S. Ser. No. 61/049,309 filed Apr. 30, 2008.

BACKGROUND

U.S. Pat. No. 5,080,773 (Tatum, et al.): discloses a ground electrode backfill at column 2, about line 18, a settable concrete composition in which the proportion of cement is relatively high so that the resulting product will set similar to conventional mixtures, and in which specific conductive substances are employed whose combination provides an enhanced level of conductivity so that an unexpectedly higher conductivity is achieved. In accordance with the present invention a relatively high level of Portland cement is combined with a relatively low level of calcined fluid petroleum coke, the primary conductive medium, and much smaller amounts of bridging conductive materials which facilitate the current flow between the coke particles.

U.S. Pat. No. 5,026,508 (Tatum, et al.): discloses a ground electrode backfill composition, anode bed. In column 2, about line 15, a settable concrete composition in which the proportion of cement is relatively high so that the resulting product will set similar to conventional mixtures and in which specific conductive substances are employed whose combination provides an enhanced level of conductivity so that an unexpectedly higher conductivity is achieved. A relatively low level of calcined fluid petroleum coke, the primary conductive medium, and much smaller amounts of bridging conductive materials which facilitate the current flow between the coke particles.

U.S. Pat. No. 4,786,388 (Tatum): discloses a ground electrode backfill composition, anode bed and apparatus. It is the purpose of this patent to prevent contamination or degradation of water quality through the transfer of material from one water bearing structure to another, or from the ground surface to a water bearing structure. The apparatus having a non-permeable concrete annulus is in contact with the earthen bore of the ground bed.

U.S. Pat. No. 4,710,644 (Baach): discloses a replaceable deep anode system. Means are provided for selectively positioning the anode in the lower portion for selective removal and replacement of the anode. A means is provided for supplying electrical energy to the anode whereby upon corrosion of the anode, the anode may be selectively retrieved and replaced in the casing while maintaining the integrity of the drilled hole.

U.S. Pat. No. 4,526,667 (Parkhurst, et al.): discloses a corrosion protection anode. An anode for a cathodic protection system comprises a non-ionized metal which exists in a liquid state at the particular pressure and temperature at its location in a hole in the earth so that gravity continuously causes the liquid anode to conform to the shape of the hole.

U.S. Pat. No. 4,525,263 (Parkhurst): discloses a method for cleaning a corrosion protection anode. An anode for a cathodic protection system which comprises a non-ionized metal which exists in a liquid state at the particular pressure and temperature at its location in a hole in the earth so that gravity continuously causes the liquid anode to conform to the shape of the whole.

U.S. Pat. No. 4,170,532 (Tatum): discloses a deep well platinized anode carrier for cathodic protection system. This patent discloses in column 2, about line 11, a deep well anode carrier for cathodic protection systems in which the carrier is placed within a deep borehole and surrounded by a carbonaceous backfill which extends upwardly substantially to the surface of the earth.

U.S. Pat. No. 3,725,669 (Tatum): discloses a deep anode bed for cathodic protection. This patent discloses on column 6, about line 58, that the flow of fluid from the hose fluidizes or suspends the granular carbonaceous material in a fluid bath so the hose will sink by gravity into such material and will continue to fluidize the carbonaceous material for the entire length of the casing. During this operation the flow of fluid is somewhat critical since there must be enough fluid being discharged from the hose to fluidize the carbonaceous material but not so much fluid that such material would be discharged from the top of the casing. When substantially all of the carbonaceous material within the casing has been fluidized, an upward lifting force is applied to the support line or the conduits to pull the remaining portion of the expended anodes from the casing. After the expended anodes have been removed, fresh anodes are placed within the casing and such anode's sink by gravity through the fluidized carbonaceous material until the anodes are located in their designed position.

DESCRIPTION OF THE PREFERRED EMBODIMENTS

Anode wells provide for a positive displacement of current distribution to protect the degradation of underground metallic structures. The anode well is generally considered one large solid anode which may be as deep as 100 to 300 feet with approximately a 10 inch diameter outer casing. Within the anode casing may be approximately 10 anode ingots inserted into the interior portion of the well at usually approximately 10 foot increments.

These anode ingots are then connected to current lines which are connected to a DC current supply. The anode ingots within the casing are surrounded by a select backfill of carbon. This select fill of carbon may be coke breeze, or other current conductive self-sacrificing carbon material. Generally the current flows from the anode through the electrolyte to the cathode. The electrolyte may be in some forms earth or groundwater. The cathode may be a pipeline or other generally metallic structure buried or submerged within the electrolyte. The positive current displacement prevents cationic loss of the metallic structure, thus preserving its structural integrity.

Figure 1:
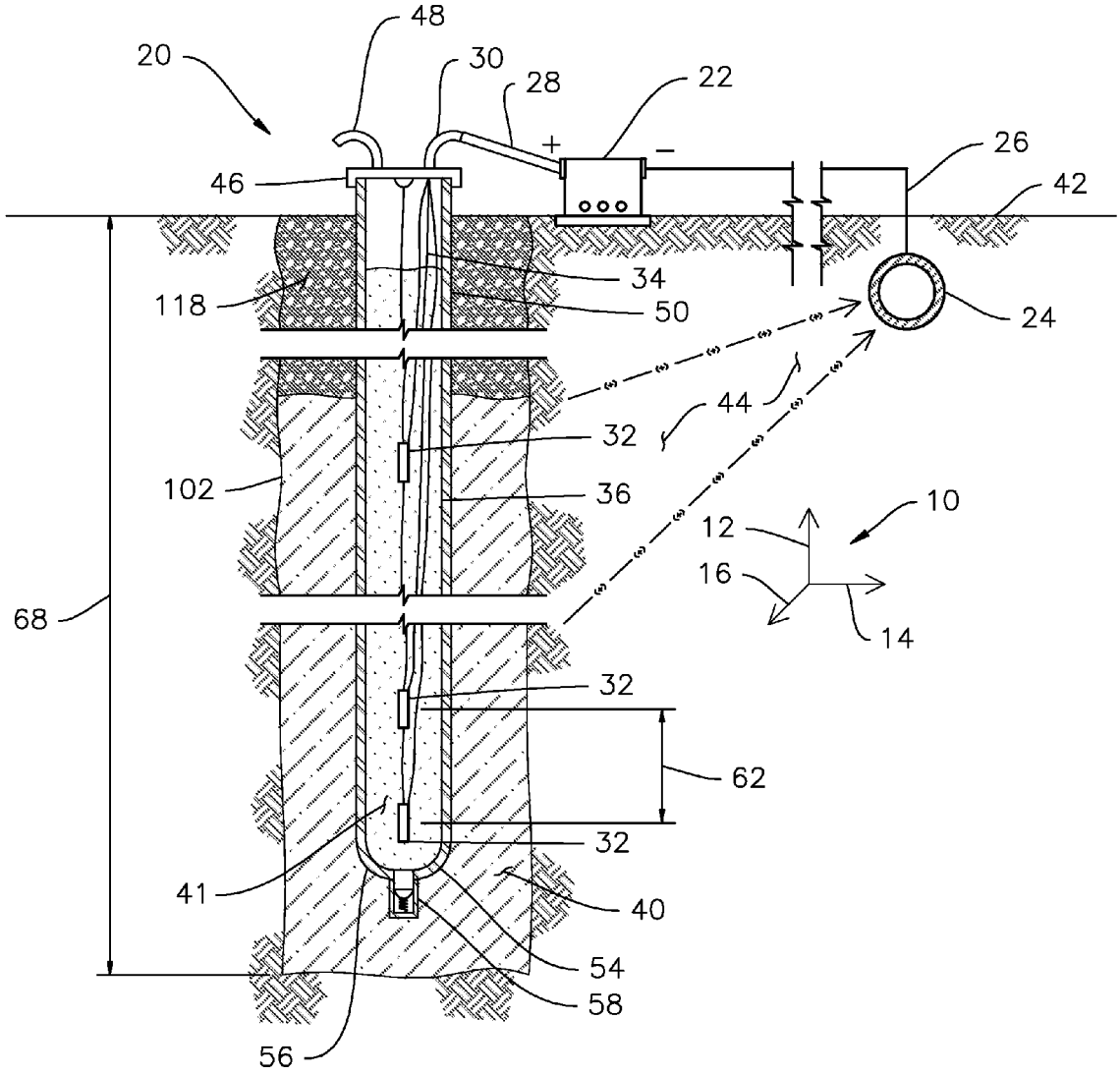
FIG. 1 is a cross-sectional elevation of an existing anode well.

Before discussing the revitalization of these pre-existing anode wells, a more brief detailed discussion of an anode well will be provided. Referring to FIG. 1, a protected pipeline structure 24 is shown in cross-section and generally extends in the transverse direction 16. In addition to a transverse direction 16, for discussion purposes there is also a vertical direction 12 and horizontal direction 14, all defining an axial system 10.

The protected structure 24 is electrically connected to a rectifier 22 by means of a current line or current lines 26. These current lines 26 are part of an electrical circuit. The rectifier 22 may also be formed of a generator. The rectifier 22 is electrically connected to the deep well assembly 20 by means of current lines 28, which are run into the deep well assembly 20 at the DC port conduit 30. The DC port conduit 30 is electrically connected to a plurality anode ingots 32 by way of anode current lines 34.

Still referring to FIG. 1, a newly constructed anode well assembly 20 may have an outer casing 36 which may be formed of current conducting steel, conductive concrete, or other current conductive material generally used within the industry. The outer casing 36 contains the anode ingots 32 which are spaced at an anode ingot interval 62 generally approximately 10 feet on center. The anode ingots 32 are surrounded by a backfill material which in many embodiments is a coke breeze which generally has the consistency of a sand type backfill.

The coke breeze is basically ground carbon which is proximately the size of salt granules. When electrolysis occurs, the carbon tends to clump and crystallize. This crystallization will also tend to occur about the anode ingots, making it extremely cumbersome to remove, if at all, the ingots when they have expired. During this crystallization process, the hydrogen component of the carbon detaches and it transitions into a gas form leaving a crystallized carbon structure which generally combines into carbon crystal nodules 112, FIG. 1B.

Generally speaking, the entire anode well is designed to lose approximately 2 pounds of carbon per amp-year. Therefore depending upon the rate of current flow, the wells are designed to last for approximately 10 to 20 years of serviceable life. On the outside of the casing 36 is additional carbon backfill 40 which transitions between the outside surface of the casing 36 and the edge of the existing ground bore 102.

The carbon backfill 40 is capped with a granular top fill 118. The casing 36 is capped with a well cap 46 and has a gas vent 48 which allows for the hydrogen gases to escape out of the well during the electrolysis process. Also the DC input conduit 30 allows the current lines 28 to run into the inner portion of the anode well. The positive current transmitted by electrical current flow is electrically transmitted through the current lines 28 and 34 to the anode ingots 32. The positive current then leaves the anode ingot 32 and travels conductively as cat ions or positive electrons through the coke breeze 41 to the well casing 36.

Current flows through the well casing 36 and the cat ions leave the surface of the well casing 36 and transfer through the backfill 40 and the electrolyte 44 and further conductively to the metallic structure 24 completing the circuit and maintaining the structural integrity of the pipeline 24.

The casing 36 over time will dissipate and be sacrificed in order to provide for conductive displacement of the positive ions to maintain the current flow. Similarly, conduction will also sacrifice the carbon backfill 40 and the coke breeze 41 leaving the previously mentioned crystallized carbon nodules 112. The carbon nodules 112 also accumulate about the anode ingots 32 rendering the current flow neutral.

Figure 1A:
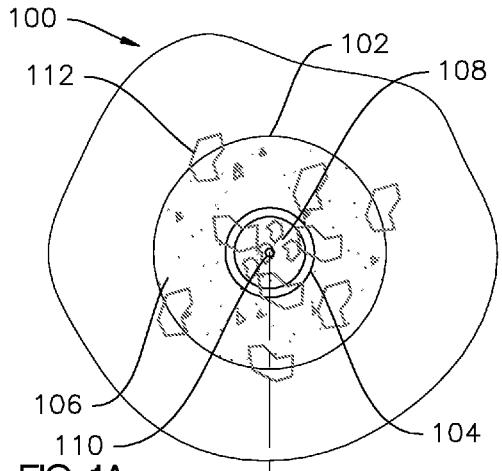
FIG. 1A is a plan view of a pre-existing expired anode well.

As the carbon backfill 40 and the coke breeze 41 coalesce into the nodules 112, voids also form within the backfill which further tends to insulate the current flow from the anode ingots 32 decreasing usefulness of the anode well 20. When this occurs and current flow is no longer possible, the existing deep anode well 100 as seen in FIG. 1A must be replaced.

Generally, a new well can be drilled in a similar location, or the existing well can be excavated and the anode ingots 32 removed and a new casing placed in the same location as the old casing with a new set of anodes connected to the rectifier with backfill coke breeze also placed within the interior portion of the new casing.

Either drilling a new well, or excavating the old well will require the disruption of water tables or ground strata, all with the likely significant environmental impacts, such as disruptive back flushing, drilling, or other contaminants into the ground water system or the surrounding surface areas. The impact requires permitting and the like, making the reinstallation process more time and cost prohibitive.

Figure 1B:
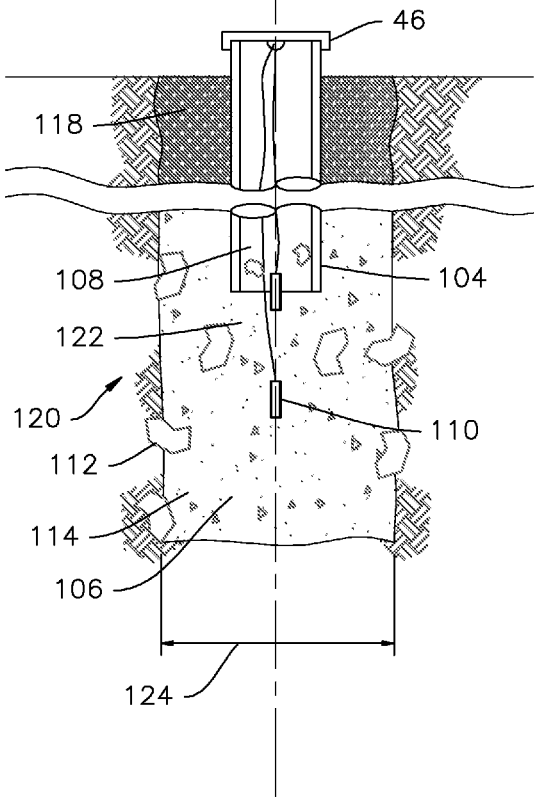
FIG. 1B is a cross-sectional elevation of a pre-existing expired anode well.

As previously mentioned, over the lifespan of the anode well, the existing deep anode well 100 as seen in FIG. 1B will tend to degrade and expire. What is left with this expiration of the anode well as seen in FIG. 1A, is the existing ground wall 102 with portions of the existing well casing 104. The electrolysis process leaves the carbon glass nodules 112 which tend to create voids and insulate the expired anode ingots 110 from transmitting current. The carbon nodules 112 are also surrounded by existing expired or sacrificed carbon medium 106.

The present system revitalizes the pre-existing well 100 with minimum impact to the surrounding environment by utilizing the existing footprint of the pre-existing anode well 100 as well as utilizing the existing sacrificed materials in conjunction with new materials to form a first well section and a second regenerative section which creates a composite reconstituted anode well 130.

Figure 2A:
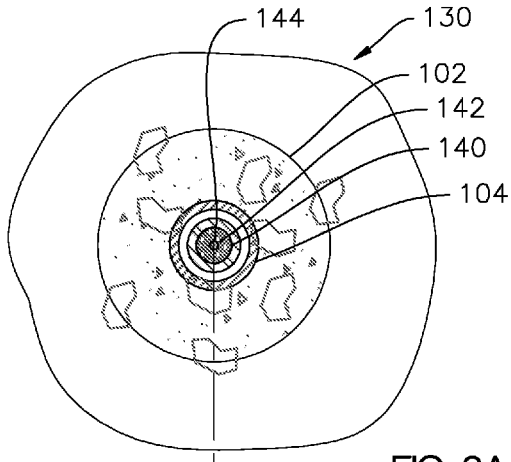
FIG. 2A is a plan view of a composite regenerated anode well.
Figure 2B:
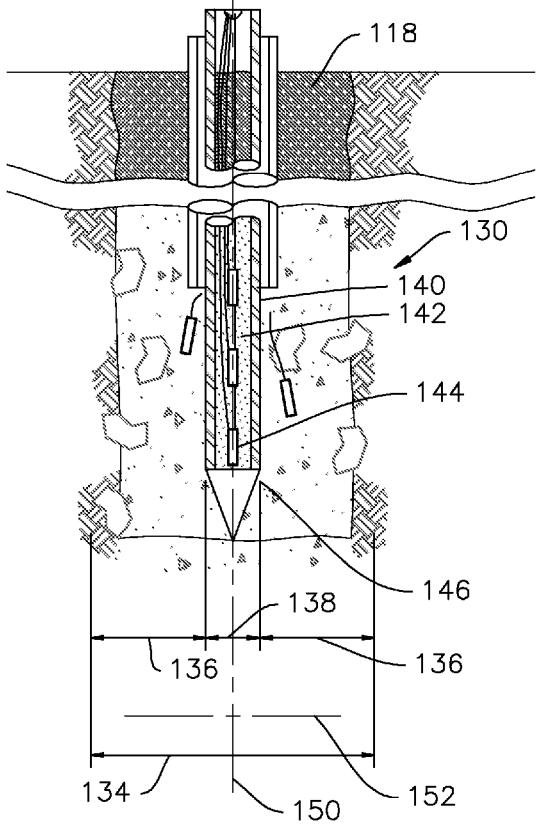
FIG. 2B is a cross-sectional elevation of a composite regenerated anode well.

Generally speaking, the first well section is the pre-existing anode earthen well wall, the pre-existing sacrificed carbon materials 106 and 112, the pre-existing first group of sacrificed anode materials 110, and the pre-existing well casing 104. The second regenerative section generally speaking as seen in FIGS. 2A and 2B, is a new regenerative well casing 140, a first group of regenerative anodes 144, and a regenerative carbon material or carbon fill 142.

In order to insert the second regenerative section into the first well section, the regenerative well casing 140 is designed to be installed within the existing deep anode well 100. As seen in FIG. 2B, the core section 138 is the first part of the composite carbon section 134, which is inserted into the existing cannibalized carbon section 124, which compacts the carbon section 136.

Figure 3:
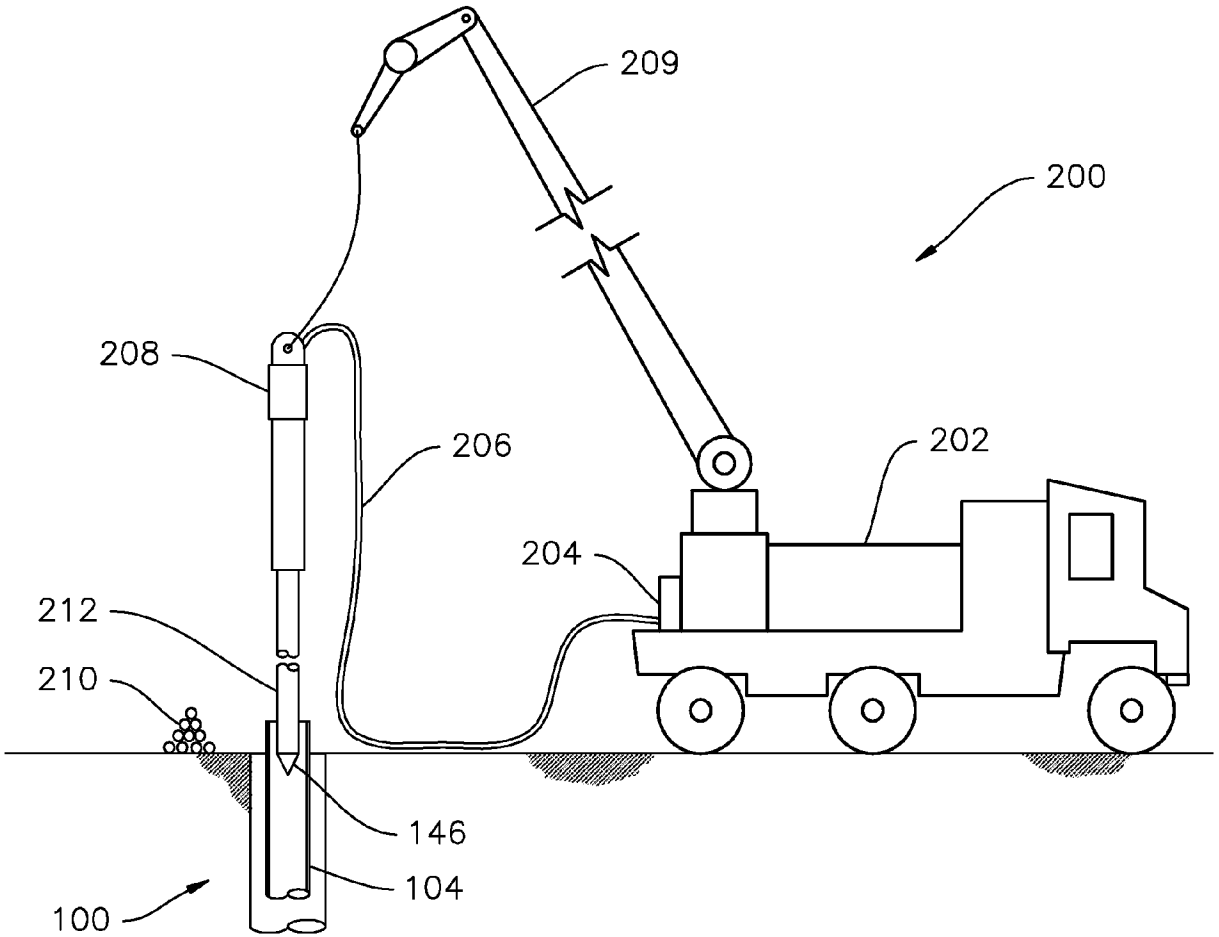
FIG. 3 is an elevation view of an assembly for reconstituting an expired anode well.

A discussion of each of the elements of the regenerative section will now be provided. The regenerative well casing 140 is generally constructed of a fore portion and a tail portion. The fore portion is the first casing which is inserted into the pre-existing anode well 100. The fore portion or lead casing 212 as seen in FIG. 3, may have a drive head 146, as seen also in FIG. 2B, which in one embodiment is a cone shaped head affixed to the fore end of the fore portion.

The regenerative well casing may be a series of interconnecting cylindrical tube steel casings, interconnecting rectilinear tube steel casings, or possibly tube casings which utilize other conductive materials. One embodiment of the tube casings provides for an inner diameter size which ranges from about 2 inches in diameter to about 10 inches in diameter.

Greater diameters are readily envisioned, such as an inner diameter of 12 inches to 18 inches or greater. The diameter may be a function of the anode well design current output parameters as well as frictional surface resistance based on force driving parameters of the new casing into the existing electrolyte medium.

Each regenerative well casing section, that being the fore portion and the tail portions have a maximum length of up to 60 feet. The 60 foot length is a function of a standard trailer bed. Generally speaking, the well casing section lengths will be provided in 10 foot to 25 foot increments depending on the well casing driving depth. The overall assembled length of the regenerative well casing will be at most equal to or about the same as the pre-existing well depth, but the regenerative well casing may be less than the pre-existing well to depending on the design parameters.

Each of the regenerative well casing sections are connectable to one another through the use of a connecting mechanism. The connecting mechanism may be a welded connection such as a fillet weld between the two end portions of the well casings. The connection may also be a threaded connection having male and female threaded portions. A bolted connection between the two portions may be utilized, as well as a sleeve type connection.

Figure 3A:
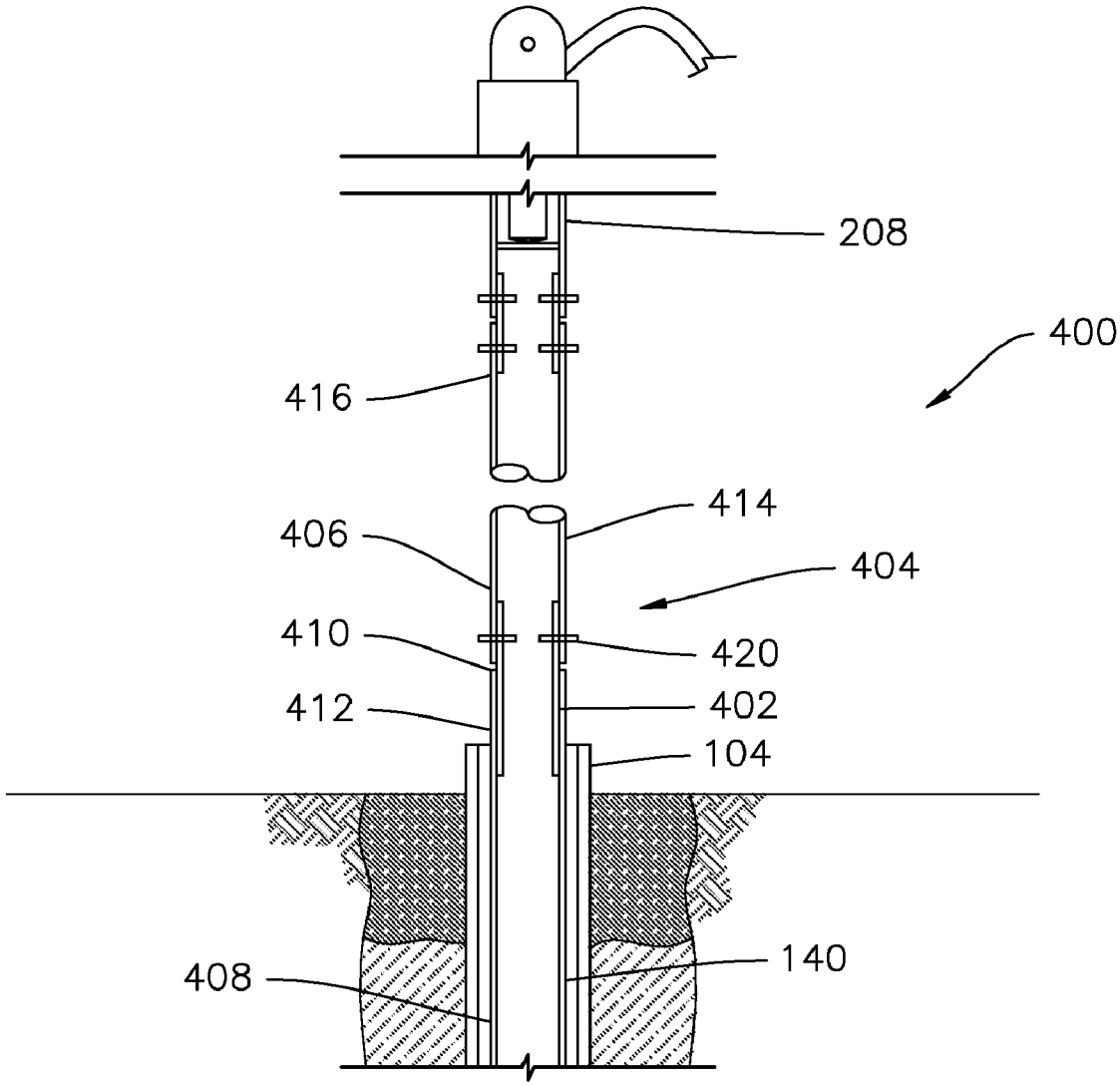
FIG. 3A is a cross-sectional elevation of a driving assembly.

Referring to FIG. 3A, a brief discussion of the driving assembly 400 will be provided with utilization of the connecting mechanism 404 which in this particular embodiment is a sleeve connection 402. The sleeve connection 402 may utilize a smaller diameter sleeve portion which is inserted into say for example, the aft end 412 of the fore portion 408 of the regenerative well casing 140. In this particular embodiment, the sleeve connection 402 is fillet welded 410 to the aft end 412.

Through holes of sufficient diameter are provided in the non-fillet welded end of the sleeve connection 402 as well as the four end 414 of the tail portion 406 which enables the connection of the tail portion 406 and fore portion 408 through the use of a cotter pin 420. Along the same lines, the sleeve connection 402 at the aft end 416 of the tail portion 406 enables the tail portion 406 to the connected to the hydraulic ram 208. In another alternative embodiment, each of the aft end portions of the fore portion and tail portions are fitted with a sleeve connection 402 where the sleeve is pre-welded onto the aft end of the casing sections prior to delivery at the installation site.

With the sleeve portion maintained within the interior portion of the regenerative will casing, the outer surface maintains its surface continuity thus reducing frictional drag during installation.

Discussing in detail the regenerative carbon fill 142, the regenerative carbon fill may be as previously discussed a coke breeze type material, it also may be a composite material utilizing coal and other soil materials.

Discussing in more detail the first group of regenerative anodes, the regenerative anodes are the regenerative anode ingots 144 which are placed within the interior portion of the regenerative well casing 140. Each of the regenerative anode ingots 144 may be one or more of the following: a titanium oxide anode, a platinized niobium anode, or a cast iron anode.

Use of the titanium oxide anodes or the platinized niobium anodes provides for greater current output with a smaller anode diameter size. The smaller diameter anodes enable the regenerative well casings to have a smaller diameter, ranging from approximately 4 inches in inner diameter to approximately 8 inches in inner diameter.

In order to install the regenerative section into the first well section, an installation assembly 200 is required as seen in FIG. 3 to install the components of the regenerative section. This includes generally speaking, the regenerative casing sections 210, the lead regenerative casing or the fore portion 212. A driving element is required to install the regenerative well casing into the pre-existing well. The driving element may be suspended by a lifting element over the pre-existing anode well. The lifting element may be configured to hold both the driving element and portions of the regenerative well casing in an installation position during the installation process.

The driving element may be a hydraulic ram 208 as seen in FIG. 3, or it also may be configured as an air hammer, water hammer or jackhammer which would provide for excavation of the pre existing well and installation of the regenerative well casings.

As seen in FIG. 3, the hydraulic ram 208 is suspended by the lifting element 209. The lifting element may be a crane, a boom, a tower, or a truck mounted crane. In this particular embodiment, a truck mounted crane is supported by a truck 202 which has a hydraulic pump 204 hydraulically connected to the hydraulic ram 208 through a hydraulic line 206.

Figure 4:
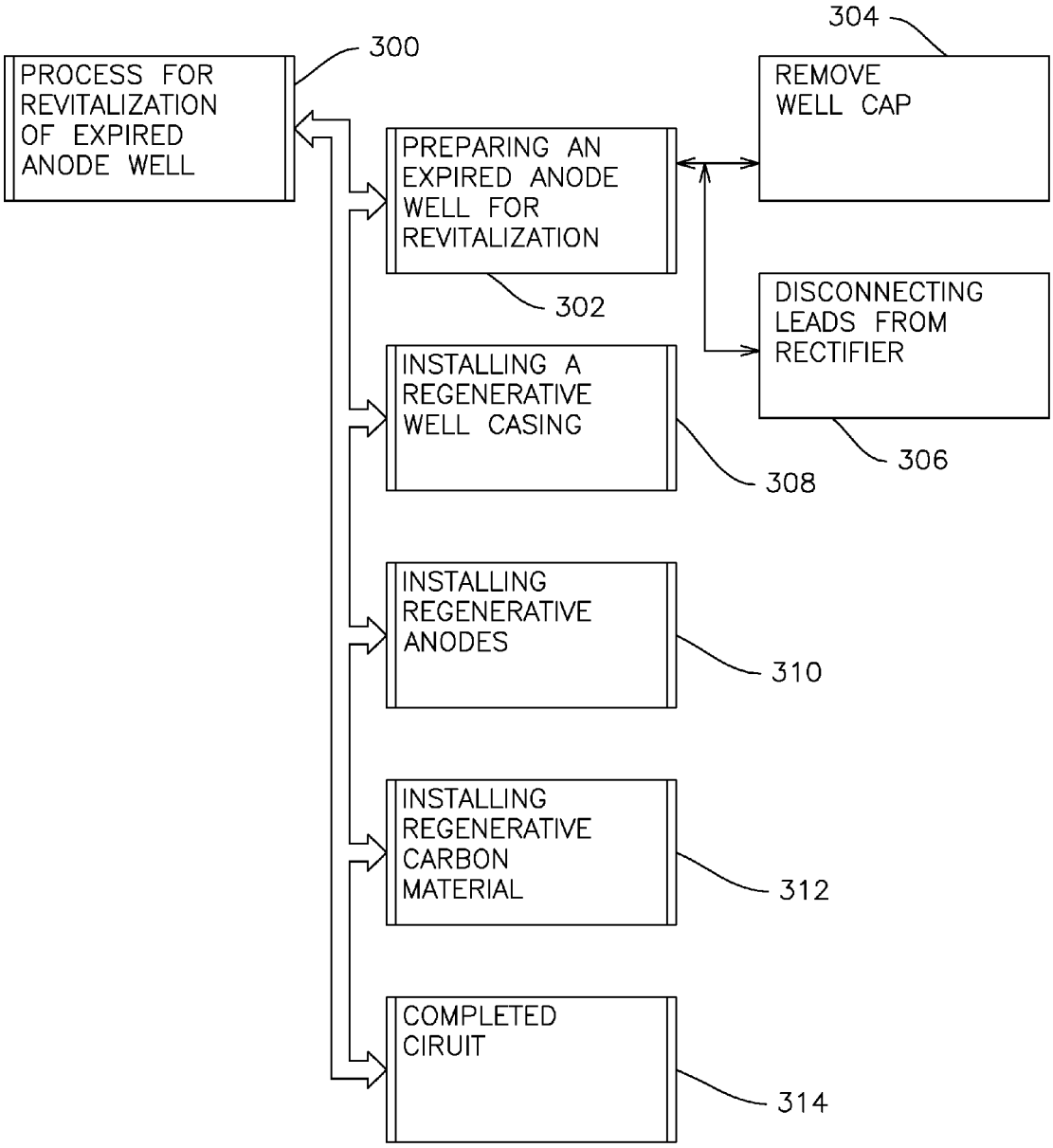
FIG. 4 is a flowchart diagram for a revitalization process of an expired anode well.

Utilizing the assembly 200, the pre-existing anode well can be revitalized through, as seen in FIG. 4, a process for revitalization of an expired anode well 300. Generally speaking, the installation of the regenerative section, can only be provided after preparation of the expired anode well for revitalization at step 302. During this step, the well cap should be removed as at step 304 and the current lines 28 FIG. 1, must be disconnected from the rectifier at step 306.

Figure 5:
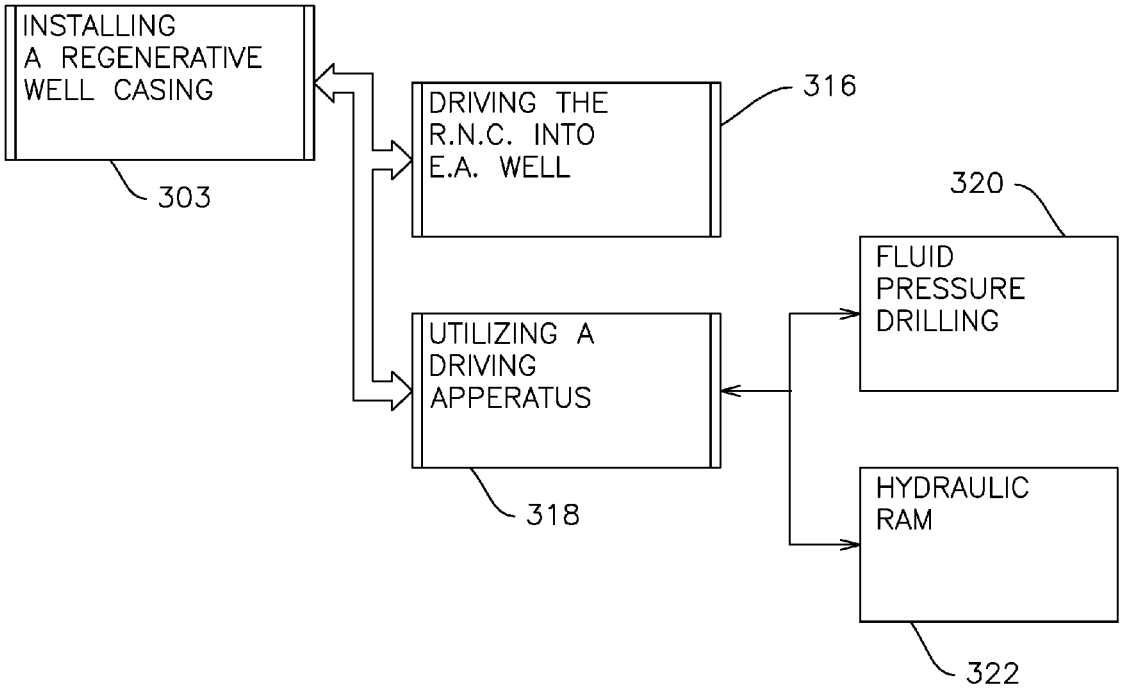
FIG. 5 is a sub-flowchart diagram of an installation process for a regenerative well casing.

Once the cap 46 has been removed the regenerative well casing can be installed at step 308. During this process, and referring to FIG. 5, the driving apparatus will be connected to the lead casing 212 at step 318. The driving apparatus is then suspended by the lifting element 209, FIG. 3, over the existing deep anode well 100. The lead casing or fore portion 212 is the first part of the regenerative well casing which is installed into the expired anode well at step 316. Various previously discussed driving mechanisms can be utilized such as a hydraulic ram, an air hammer, a water hammer, or a jackhammer.

With the lead casing 212 installed into the existing deep anode well 100, subsequent regenerative well casing sections 210 (or in other words the tail portions) can be connected to the lead casing and the driving element 208 for further downward installation of the regenerative well casing into the existing well. During this process, the regenerative well casing compacts by forcing downwards and transversely to the side, the first well section materials which include the pre-existing anode earthen wall, the pre-existing sacrificed carbon materials, the pre-existing first group of sacrificed anode materials, and the pre-existing sacrificed well casing.

During this installation and compaction process, the voids 114 FIG. 1B, which were pre-existing as well as the carbon nodules 112, are compacted and broken up. This breaking and compaction process of the pre-existing materials helps to re-establish material continuity for conduction of electrical current.

After the regenerative well casing is full installed at step 308, installation of the regenerative anodes at step 310 is provided. Here the previously mentioned titanium anodes, platinized niobium anode's, or cast iron anodes are installed at the anode ingot interval spacing 62 as seen in FIG. 1. With the anode ingots installed, the regenerative carbon fill 142 can be placed into the interior portion of the regenerative well casing 140 at step 312. Once the regenerative carbon material is installed, the circuit can be completed at step 314 by reconnecting the current lines to the rectifier and beginning the current transmission process to maintain the structural integrity of the underground or partially underground structure 24.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

We claim:

1. A composite reconstituted anode well, said well arranged about a centrally aligned vertical axis and defining a substantially perpendicular and radially aligned axial system, said well comprising:

a. a first well section, said first well section comprising: a pre-existing anode well earthen wall, a pre-existing sacrificed carbon material, a pre-existing first group of sacrificed anode materials, a pre-existing sacrificed well casing;

b. a second regenerative section comprising: a regenerative well casing, a first group of regenerative anodes, a regenerative carbon material;

c. said regenerative well casing driven into said first well section to compact along said radial and vertical axial system said pre-existing sacrificed carbon material, said pre-existing first group of sacrificed anode materials, said pre-existing sacrificed well casing against said pre-existing anode well earthen wall to form a first outer section;

d. said first group of regenerative anodes placed into said first regenerative well casing, said regenerative carbon material then placed into said first regenerative well casing to encase said first group of regenerative anodes and form an inner well section;

e. whereby the combination of said inner well section and said first outer section results in said composite reconstituted anode well.

2. The anode well according to claim 1 wherein said regenerative well casing further comprises: a fore portion and a tail portion.

3. The anode well according to claim 2 wherein said fore portion further comprises: a coned shaped head affixed to a fore end of said fore portion enabling said fore portion to be driven into said first well section.

4. The anode well according to claim 1 wherein said regenerative well casing further comprises: a cylindrical tube steel casing.

5. The anode well according to claim 1 wherein said regenerative well casing further comprises: a rectilinear tube steel casing.

6. The anode well according to claim 4 wherein said cylindrical tube steel casing further comprises: an inner diameter size ranging from about 2 inches in diameter to about 10 inches in diameter.

7. The anode well according to claim 2 wherein each of said fore portion and tail portion have a maximum length up to about 60 feet in length.

8. The anode well according to claim 1 wherein said regenerative well casing further comprises: an overall assembled length at most about equal to the pre existing well length.

9. The anode well according to claim 1 wherein said regenerative well casing further comprises: a fore portion connected to a tail portion, said tail portion comprising a group of tail sections each interoperably connected to one another; each of said fore portion and tail portions connected by a connecting mechanism.

10. The anode well according to claim 9 wherein said connecting mechanism further comprises: a weld connection.

11. The anode well according to claim 9 wherein said connecting mechanism further comprises: a threaded connection.

12. The anode well according to claim 9 wherein said connecting mechanism further comprises: a bolted connection.

13. The anode well according to claim 9 wherein said connecting mechanism further comprises: a sleeve connection.

14. The anode well according to claim 1 wherein said regenerative carbon material further comprises: coke breeze.

15. The anode well according to claim 1 wherein said first group of regenerative anodes further comprise: titanium oxide anodes.

16. The anode well according to claim 1 wherein said first group of regenerative anodes further comprise: platinized niobium anodes.

17. The anode well according to claim 1 wherein said first group of regenerative anodes further comprise: cast iron anodes.

18. An assembly for reconstituting an expired anode well, said assembly comprising:

a. a regenerative carbon material configured to encase a first group of regenerative anodes within a regenerative well casing;

b. said regenerative well casing comprising a fore portion inter-operably connectable to a tail portion, said tail portion comprising a group of tail sections each inter-operably connectable to one another; said fore portion and said tail portion inter-operably connectable by a connecting mechanism;

c. each of said fore portion and tail portions configured to inter-operably connect to a driving element; said driving element configured to inter-operably connect to a lifting element;

d. said lifting element configured to lift said driving element and said regenerative well casing into an installation position above said expired anode well;

e. said driving element configured to drive said regenerative well casing into said expired anode well;

a. said regenerative well casing configured to receive said first group of regenerative anodes and said regenerative carbon material to revitalize said expired anode well.

19. The assembly according to claim 18 wherein said regenerative carbon material further comprises coke breeze.

20. The assembly according to claim 18 wherein said first group of regenerative anodes further comprises: titanium oxide anodes.

21. The assembly according to claim 18 wherein said first group of regenerative anodes further comprises: platinized niobium anodes.

22. The assembly according to claim 18 wherein said first group of regenerative anodes further comprises: cast iron anodes.

23. The assembly according to claim 18 wherein said regenerative well casing further comprises: a cylindrical tube steel casing.

24. The assembly according to claim 18 wherein said regenerative well casing further comprises: a rectilinear tube steel casing.

25. The assembly according to claim 18 wherein said connecting mechanism further comprises: a weld connection.

26. The assembly according to claim 18 wherein said connecting mechanism further comprises: a threaded connection.

27. The assembly according to claim 18 wherein said connecting mechanism further comprises: a bolted connection.

28. The assembly according to claim 18 wherein said connecting mechanism further comprises: a sleeve connection.

29. The assembly according to claim 18 wherein said driving element further comprises: a hydraulic hammer.

30. The assembly according to claim 18 wherein said driving element further comprises at least one of the following: an air hammer; a fluid hammer; a jackhammer.

31. The assembly according to claim 18 wherein said lifting element further comprises: a crane.

32. The assembly according to claim 18 wherein said lifting element further comprises: a boom.

33. The assembly according to claim 18 wherein said lifting element further comprises: a tower.

34. The assembly according to claim 18 wherein said lifting element further comprises: a truck mounted crane.

35. The assembly according to claim 18 wherein said fore portion further comprises: a cone shaped head affixed to a fore end of said fore portion.

36. A method for revitalizing an expired anode well, said method comprising:

a. preparing an expired anode well for revitalization by removing a well cap and disconnecting leads from a rectifier;

b. installing a regenerative well casing into said expired anode well;

c. installing a first group of regenerative anodes into said regenerative well casing;

d. installing regenerative carbon material into said regenerative well casing and about said regenerative anodes;

e. completing a cathodization circuit by connecting said first group of regenerative anodes to said rectifier.

37. The method according to claim 36 wherein said installing a regenerative well casing further comprises:

a. utilizing a driving apparatus connected to said well casing and suspended from a lifting element to position said well casing above said expired anode well; and, b. driving said regenerative well casing into said expired anode well.

* * * * *